US005090282A

United States Patent [19]

Rüesch

[11] Patent Number: 5,090,282

[45] Date of Patent: Feb. 25, 1992

[54] METHOD OF AND APPARATUS FOR REDUCING THE PUNCHING STRESS OF A PUNCHING MACHINE HAVING FIXED ABUTMENTS

[75] Inventor: Peter Rüesch, Rorschacherberg, Switzerland

[73] Assignee: Bruderer AG, Frasnacht, Switzerland

[21] Appl. No.: 707,996

[22] Filed: May 23, 1991

Related U.S. Application Data

[63] Continuation-in-part of Ser. No. 379,999, Jul. 14, 1989, abandoned.

[30] Foreign Application Priority Data

Jul. 28, 1988 [CH] Switzerland ..... 2870/88

[51] Int. Cl.[5] ..... B26D 7/26; B30B 15/14

[52] U.S. Cl. ..... 83/13; 83/74; 83/76.7; 83/530; 73/104; 100/257

[58] Field of Search ..... 73/104; 100/257; 83/74, 83/75, 530, 527, 13, 76.7

[56] References Cited

U.S. PATENT DOCUMENTS 4,378,717 4/1983 Schneider et al. ..... 83/530
4,538,493 9/1985 Perazzolo et al. ..... 83/530
4,676,090 6/1987 Nishimura et al. ..... 83/527 X
4,875,305 10/1989 Powell et al. ..... 73/104

*Primary Examiner*—Mark Rosenbaum
*Assistant Examiner*—Rinaldi Rada
*Attorney, Agent, or Firm*—Ladas & Parry

[57] ABSTRACT

The limiting of the movement of the stroke of the ram is made by at least one fixed abutment. At least one fixed abutment includes a feeler, which determines the elastic deformation of the respective abutment which is generated by the striking force of the ram. The outgoing signals of the respective sensor are led to a control unit for the adjusting of the height position of the ram. This adjusting of the height position of the ram proceeds via an adjusting motor followed by a gear train. By means of the fixed abutments the position of the lower dead point of the ram relative to the punching tool lower part may be adjusted in accordance with the prevailing conditions. Conclusively, it is also possible to exactly set the depth of immersion of the punching tool upper part with its dies in the punching tool lower part, which thus can amount also to 0 or even less. The height position of the ram which is adjusted in dependence from the striking force exerted on the fixed abutments reduces the overall loading of the punching machine, which loading otherwise would considerably increase at an increasing number of strokes.

18 Claims, 4 Drawing Sheets

METHOD OF AND APPARATUS FOR REDUCING THE PUNCHING STRESS OF A PUNCHING MACHINE HAVING FIXED ABUTMENTS

This is a continuation-in-part of copending application(s) Ser. No. 07/379,999 filed on July 14, 1989, now abandoned.

BACKGROUND OF THE INVENTION

1. Field of the Invention

The present invention relates to a method of reducing the punching stress of a punching machine having a ram, in which punching machine a relative position of the punching tool upper part and the punching tool lower part is set by at least one mechanical or fixed abutment. The invention relates further to an apparatus for reducing the punching stress of a punching machine having a ram and at least one fixed abutment operative to set a relative position of the punching tool upper part and the punching tool lower part. At least one fixed abutment is mounted in the punching tool upper part and/or in the punching tool lower part, and the punching press includes a control means having an adjusting motor and is operative to adjust the height position of the ram during the working operation of the machine.

2. Description of the Prior Art

The height position of the ram specifically in case of high speed punching machines is a matter which must be given particular attention. An extremely precise lower dead point position of the ram within the entire range of operational speeds is, for instance, necessary if precise bends, embossments, cutting and scoring of tear-off covers are needed. If the lower dead point position is not maintained precisely, waste is produced. It is, furthermore, a desire to keep the immersing of the cutting dies of the punching tool upper part into the punching tool lower part at a minimal value such that during the resharpening of the tool as little material as possible must be ground away from the cutting plate. In case of a larger depth of immersion, more material must be removed from the stamp or die, and from the bottom die than in the case of a smaller depth of immersion. Accordingly, a tool must be resharpened less often until a complete replacing thereof is necessary.

Where more frequent resharpening of the tools is necessary quite obviously the number of parts produced by one given tool is less and correspondingly the production costs are higher.

In order to avoid such undesirable conditions it is a common procedure to provide fixed abutments at the punching tool lower part and the punching tool upper part. These fixed abutments maintain the relative end position of the punching tool upper part relative to the punching tool lower part constant over the entire speed range (i.e. number of strokes) of a given punching machine. However, the minimal necessary striking forces at a low number of strokes rise considerably with an increasing number of strokes and accordingly place quite a strain or stress, on a punching machine (see FIG. 3).

SUMMARY OF THE INVENTION

It is, therefore, a general object of the present invention to provide a method and an apparatus for practicing such method, by means of which the strains imposed on a punching machine having fixed abutments can be reduced.

A further object of the invention is to provide a method of reducing the punching stress, which comprises the steps of measuring the respective striking force exerted on the mechanical abutment of the punching machine and of adjusting the height position of the ram in dependence of the measured striking force, such that latter remains within a set range.

Yet a further object of the invention is to provide an apparatus for reducing the punching stress of a punching machine and including one or a plurality of means for sensing the respective striking force exerted on the fixed abutment, which sensing means are coupled to the adjusting means for adjusting the height position of the ram, whereby the output signal of said sensing means is transmitted to the height position adjusting means.

BRIEF DESCRIPTION OF THE DRAWINGS

The present invention will be better understood and objects other than those set forth above will become apparent when consideration is given to the following detailed description thereof. Such description makes reference to the annexed drawings, wherein.

DESCRIPTION OF THE PREFERRED EMBODIMENT

Figure 1:
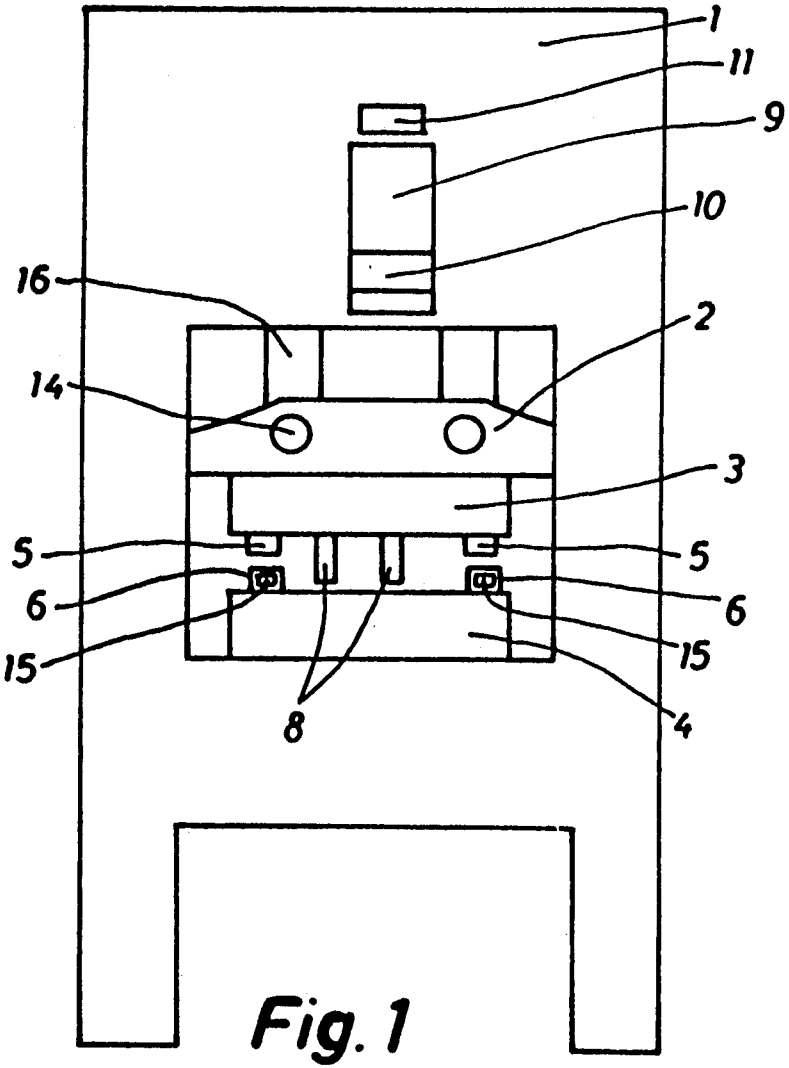
FIG. 1 is a schematic front view of a punching press for explaining the present invention.

The punching machine illustrated schematically in FIG. 1 is identified generally by the reference numeral 1. Further illustrated is the ram 2, which is pivoted via pivot pins 14 to crank arms 16 of a not specifically illustrated crankshaft, eccentric shaft or other design of suitable drive. It shall here be noted, that these mentioned structures are only an example of the drive of the ram 2.

A punching tool upper part 3 is mounted to the ram 2, which punching tool upper part 3 cooperates with a punching tool lower part 4 mounted on the workbench 20, for instance, with cutting plates.

The height of the ram of this high speed punching machine is adjustable during the working operation thereof, to which end a schematically illustrated adjusting motor 9 is provided, which motor 9 acts via a gear train 10 onto the ram 2.

The position indicator for the adjustment of the height of the ram is indicated by the reference numeral 11. Cutting dies 8 are set in the punching tool upper part 3.

According to the schematic illustration of FIG. 1, two fixed abutments 5 are located in the tool upper part 3. Two further fixed abutments 6 are, furthermore, drawn in the tool lower part 4. It must be noted, that this illustration is an example only. Basically only one fixed abutment is necessary in one of the two tool parts, specifically and generally in the lower punching tool part 4. It is also possible to use more than two fixed abutments in a given tool part or in case of multiple press tools or follow dies, respectively, only one operating station may be provided with at least one fixed abutment or stop.

Figure 2:
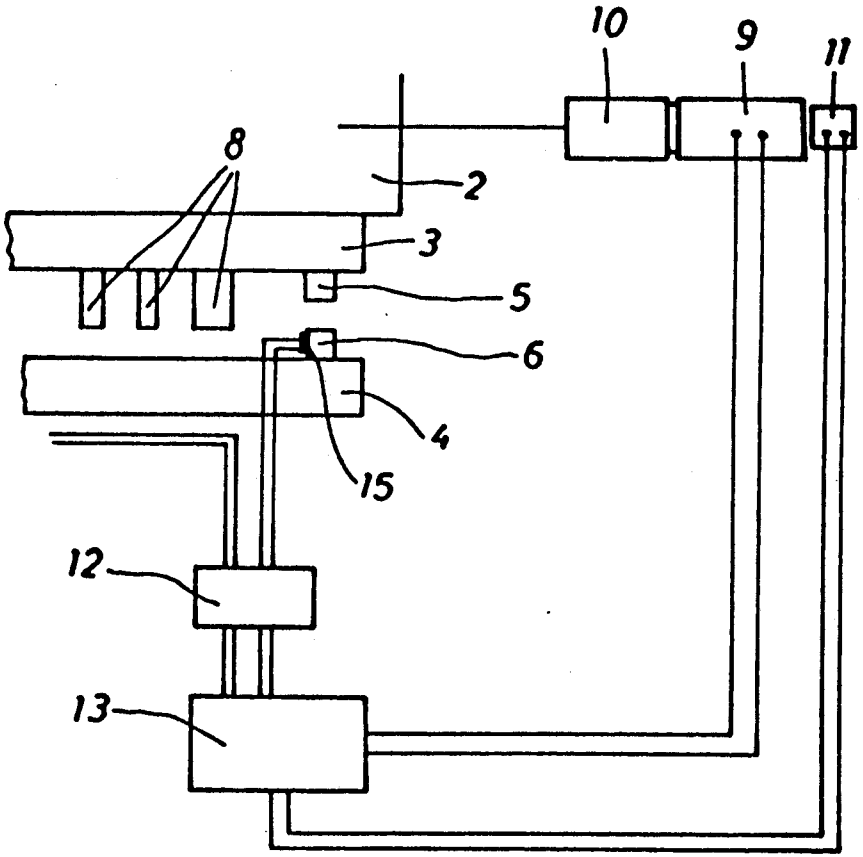
FIG. 2 illustrates a part of a control circuit for the adjusting of the height of the ram.
Figure 9:
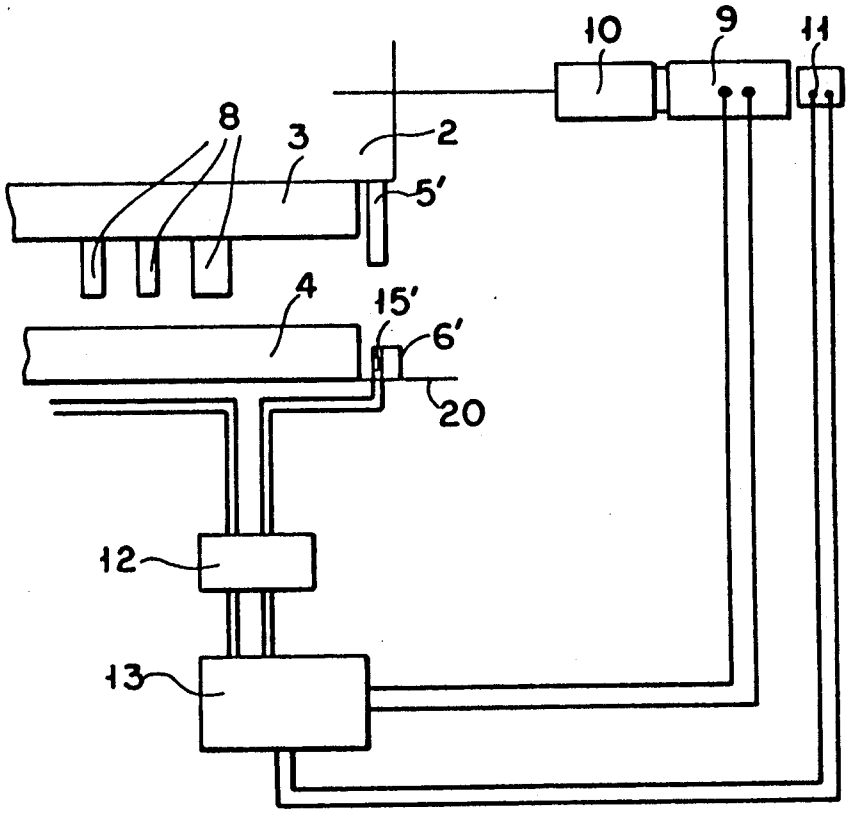
FIG. 9 illustrates a part of a control circuit for adjusting the height of the ram in accordance with this alternate embodiment.
Figure 8:
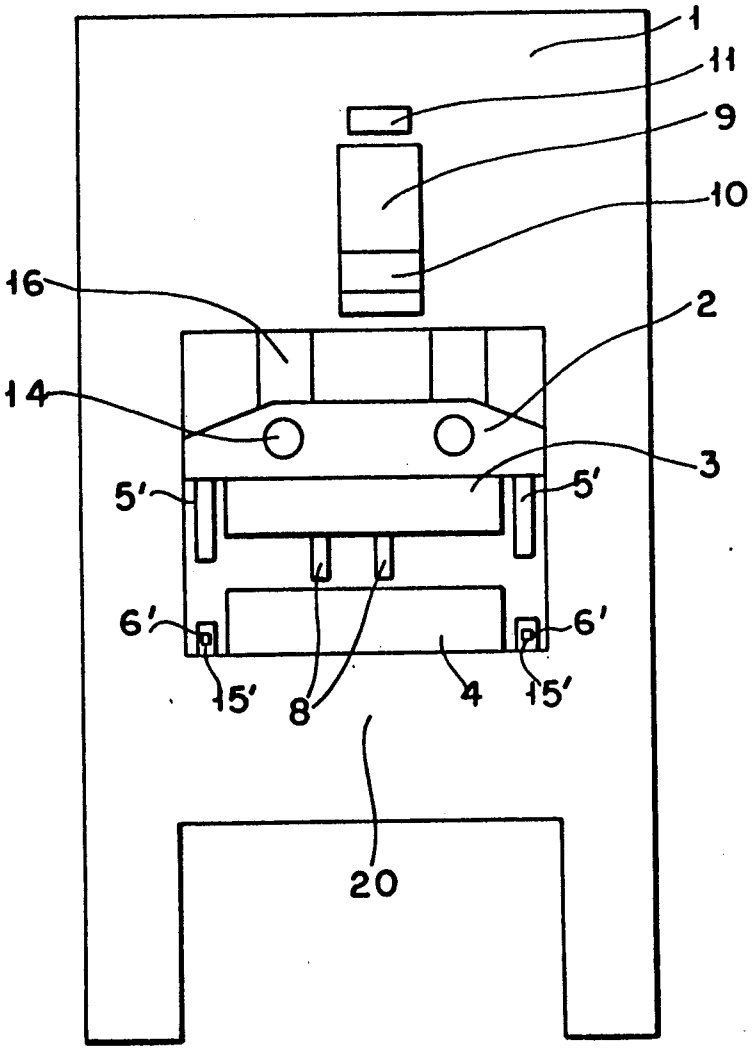
FIG. 8 is a schematic front view of a punching press according to an alternate embodiment of the present invention.

FIGS. 8 and 9 illustrate an alternate embodiment of the present invention which is identical to the embodiment shown in FIGS. 1 and 2 except that the two fixed abutments 5' are located on the ram 2 and the two fixed abutments 6' having members 15' are attached to the workbench 20.

These fixed abutments may be, for instance, a steel block, a steel cylinder etc. Due to the fact that the stroke movement of the tool upper part 3 relative to the tool lower part 4 is limited in the area of the lower dead point by at least one fixed abutment, it is guaranteed that no or only a minimal necessary immersing of the tool upper part 3 in the tool lower part 4 occurs. The depth of immersion amounts to 0 or the desired value This value of immersion which generates wear may, such as in case of an embossing for example, attain also negative values. That is, the cutting die will in such case not reach the lower die. Quite obviously, a certain depth of immersion can be made possible by means of a corresponding selection of the location of the height of the fixed abutments, depending on the prevailing conditions regarding the tools.

If the position of the height of the ram is too low or becomes too low due to the high rotational speeds of the high speed punching machine, a markedly higher striking force on the respective fixed abutment will occur. Accordingly, at least one fixed abutment is provided with one or a plurality of feelers for determining the striking force. In the illustrated embodiment two fixed abutments 6 are arranged in the punching tool lower part 4, which abutments 6 include a feeler each.

Quite obviously, the striking of e.g. the punching tool upper part 3 onto a respective fixed abutment 6 causes latter to deform elastically in the direction of the stroke of the ram because a striking force is exerted on such abutment. This elastic deformation is quite obviously extremely small, but may just the same still be sensed by a suitable device. It is, for instance, possible to locate a wire strain gauge which is in a generally known way connected via a Wheatstone bridge at a respective fixed abutment or a piezoelectric gauge may be provided.

Attention is now drawn to FIG. 2. This figure illustrates the ram 2, a fixed abutment 5 in the punching tool upper part 3 and a fixed abutment 6 in the punching tool lower part 4. Furthermore, some cutting dies 8 are illustrated.

The fixed abutment 6 has now a structural member 15 such as described above, which member 15 emits an electric signal dependent on the respective striking force registered by the elastic deformation of the fixed abutment 6.

This signal is fed to a signal amplifier 12 and the output of this signal amplifier 12 is connected to a control unit 13 for the adjusting of the height of the ram. This control unit 13 is coupled to the adjusting motor 9 for the adjusting of the height of the ram and to the position indicator 11 of the ram height adjustment. The adjusting motor 9 drives the gear train 10 for the adjusting of the height of the ram. Mentioned structural units 9–11 and 13 are of a generally known design, such as is the case for the signal amplifier 12, and thus a detailed description of these units or apparatuses, respectively, is not necessary.

The operation of the above described embodiment is as follows. It shall be assumed, that during the operation of the punching machine, a striking onto a fixed abutment happens at every stroke of the machine. As already mentioned, the tiny elastic deformation of the fixed abutment caused by the striking is transformed into an electric signal. Quite obviously now a precisely determinable striking force and accordingly electric signal corresponds to a correct operation of the design-height position of the ram. It is now not absolutely necessary that only one precise value is set, it is rather a range, i.e. a value which has tolerances.

If now the position of the height of the ram is too high such that no or a too weak striking onto the fixed abutment is caused, it is possible that waste is produced because a corresponding part of the tool, for instance, an embossing die, does not enter far enough into a workpiece during the embossing thereof or that such die does not penetrate completely through a workpiece to be cut. Now, the corresponding signal is below a preset limit. This condition is sensed in the control unit 13, which accordingly transmits a signal to the adjusting motor 9 for the adjusting of the height of the ram. The signal causes an adjusting of the height of the ram until such striking force for correct operation has been reached which is necessary such that the striking force is adjusted.

In case a too great striking force relative to the preset value or range, respectively, is sensed, it signals a height of the ram which is too small or too low, respectively, which condition leads to an undesired additional stressing or straining, of the punching machine. Correspondingly, the adjusting motor 9 is controlled such that the height of the ram is increased until again a preset striking force is generated and correspondingly the punching press stress relieved.

This controlling of the height of the ram occurs specifically in case of varying rotational speeds or numbers of strokes, respectively, in the case of high speed punching machines, e.g. during the start-up or during changes of the number of the strokes during the normal operation. It is generally known that in the case of uncontrolled punching machines, the depth of the immersion of an upper tool into a corresponding lower tool increases together with the increasing speed of operation, i.e. higher number of strokes. In the present design the fixed abutments guarantee that the depth of the immersion is absolutely limited or if necessary amounts even to 0. The height of the ram can be now controlled during the operation of the machine in dependence on the prevailing conditions, whereby the basis of the controlling is not based on a measure e.g. of the rotational speed, but rather on the actually generated striking force. This striking force is thereby sensed directly on the machine part which is subject to this force, namely on the fixed abutment stop, where an elastic deformation is sensed. Accordingly, no measuring at a location remote from the location of the striking onto the fixed abutment is made, which remote measuring cannot be precise due to deformations at parts of the machine, due to changes in the bearings during the operating of the machine, etc. Accordingly, it is made possible by the present invention to maintain the loading on the fixed abutment stops, i.e. the striking force occurring thereon constant also during a change of the number of strokes. During a start-up, i.e. initial putting into operation, of a newly equipped machine it is possible to set a selectable base correction with regard to the height of the ram in dependence on the number of strokes in the control unit 13. After the coupling of the machine to the drive it is then possible to switch over to control which is dependent on the preset striking force value corresponding to the values received from the sensor or the sensors, respectively. It is also possible to set in the control unit 13 the height of the ram correction which depends on the number of strokes, whereafter then the values delivered from the sensors correct the previously set values in an overriding fashion. The controlling of the height of the ram, i.e. the adjusting thereof, also takes place in case of changing temperature conditions, for instance, when the punching machine is still cold during the start-up as well as in case of changing ambient temperatures.

Figure 3:
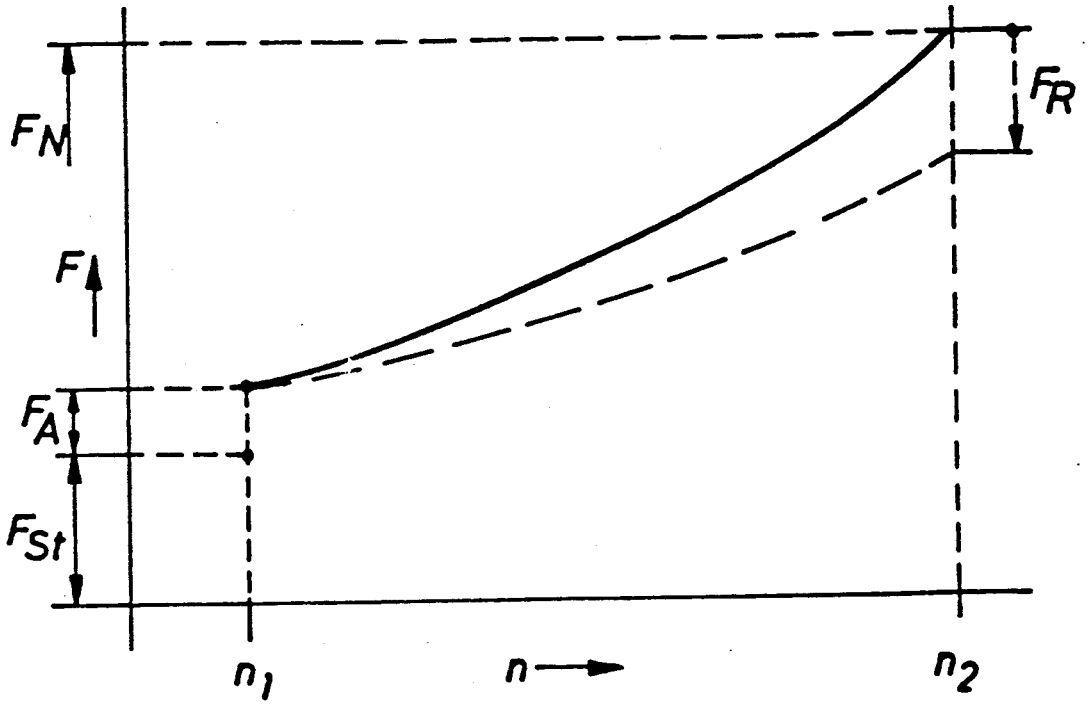
FIGS. 3 and 4 are diagrams, in which the cause of the stressing of the punching machine at a rising number of strokes is illustrated.
Figure 4:
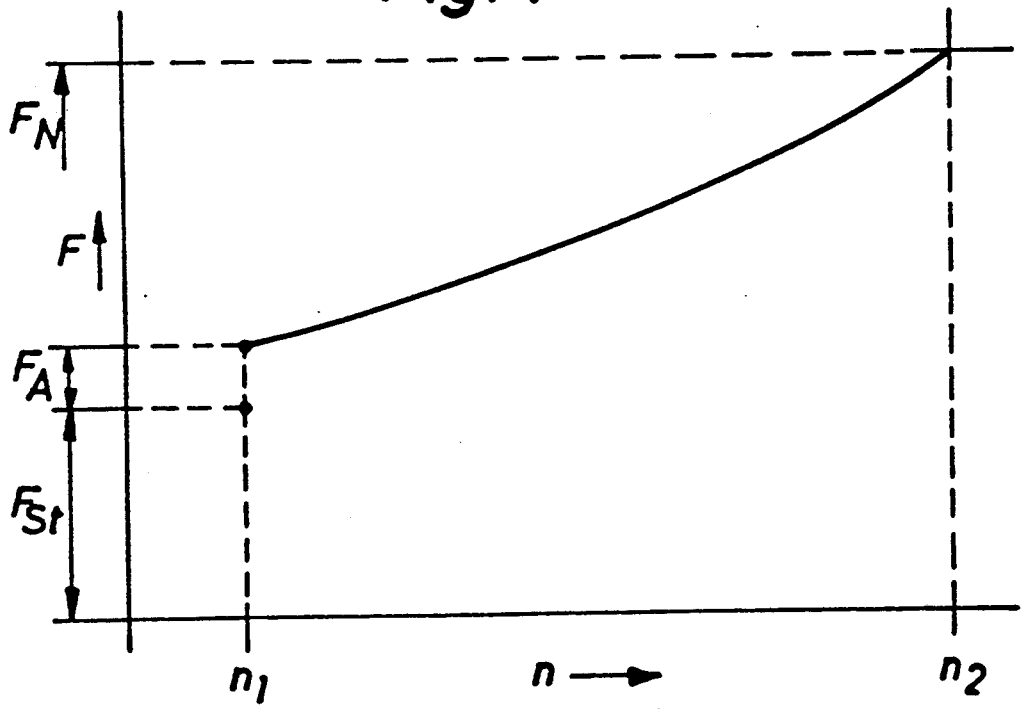

Attention is now drawn to FIGS. 3 and 4. The speed (number of strokes) of a prevailing punching press is identified by "n" and the loading of the stamping machine generally by "F". Basically, a punching press is designed for a nominal pressing force $F_N$. This design determines accordingly the size of the machine and thereby decisively the purchasing price for the user of a prevailing machine. The cutting force or embossing force, respectively, is identified by $F_{St}$. This is the force generated in the tool and the punching press must now be able to apply this force for a respective working cycle, i.e. stamping, embossing, bending, etc. in accordance with the products being produced. The striking force occurring on the fixed abutment or fixed abutments, respectively, which force must also be taken up by the punching machine, is identied by $F_A$. The sum $F_{St}+F_A$ determines accordingly the force which the punching machine must be able to exert (neglecting inner losses of the machine occurring, for instance, due to frictions in bearings), which force value accordingly determines the size of the machine and at the last instance the costs of purchasing same.

The diagram in FIG. 3 sets out at a given number of strokes $n_1$, for instance 100 strokes per minute. The loading of the press F is, therefore, made up by $F_{St}+F_A$. The conditions are based on the fact that a tool having fixed abutments is present. A further condition shall be, that the height of the ram remains the same, i.e. that no measures occur regarding adjusting of the height of the ram (for instance dependent on the number of strokes or the magnitude of the striking force) such that accordingly the force which must be exerted by the punching press rises together with a rising number of strokes. The force of the punch F increases at an increasing n in correspondence with the fully drawn curve in FIG. 3. The number of strokes $n_2$, for instance 1000 strokes per minute, shall be assumed to be the maximal number of strokes of this punching machine. The operation condition $n_2$ leads now to the nominal punching force $F_N$ of this punching machine, accordingly also the design size and finally costs thereof.

The curve which is designed by a broken line indicates now the pressing or punching force F which must be generated by a punching machine, which includes now an adjusting of the height of the ram in accordance with the present invention. It is specifically to be noted that the striking force onto the fixed abutment or fixed abutments, respectively, is kept low due to the in this case made adjusting of the height of the ram constant in the entire range of the number of strokes. The curve designed as a broken line extends below the fully drawn line again up to the maximal number of strokes $n_2$. Accordingly, a decisive decrease of the pressing or punching, respectively, force which must be generated by the machine follows thereby, which reduction is marked by $F_R$. Comparing correspondingly to machines of the same design, a reduction of the loading thereof in latter case amounts to 20 to 30%! This means now that in case of fixed abutments combined with an adjusting of the height of the ram the punching press which must be acquired must not be designed for the same working output $F_N$, but rather for $F_N$-$F_R$. Accordingly, a "smaller" machine is arrived at, which leads to decisive savings on purchasing costs of such machine.

Attention is now drawn to FIG. 4, in which all reference identifications correspond to those of FIG. 3. The diagram is based on a punching press, which is identical to the one of FIG. 3 and having a nominal pressing force $F_N$. Therefore it is a machine, in which the loading without adjusting of the height of the ram increases at a rising number of strokes along the fully drawn curve (of FIG. 3).

The punching machine, on which the diagram of FIG. 4 is based, includes an adjustment of the height of the ram as well as a limiting of the stroke by means of fixed abutments. The value $F_A$, i.e. accordingly the striking force onto a respective fixed abutment, at the number of strokes $n_1$ is the same as that of FIG. 3 and is kept constant during a rising number of strokes. Because, however, the loading of the punching machine at a rising number of strokes up to $n_2$ can rise again to the same value $F_N$ in accordance with the nominal punching force, $F_{St}$ can be correspondingly and markedly greater. This means that in case of a prevailing punching machine which is equipped with fixed abutments and a controlling of the height adjustment of the ram, the operating force which is available is markedly larger. The difference can amount up to 40%. This leads obviously to considerable savings when purchasing a punching machine because a correspondingly equipped punching machine gives now a much higher operating force for the working of workpieces.

Figure 5:
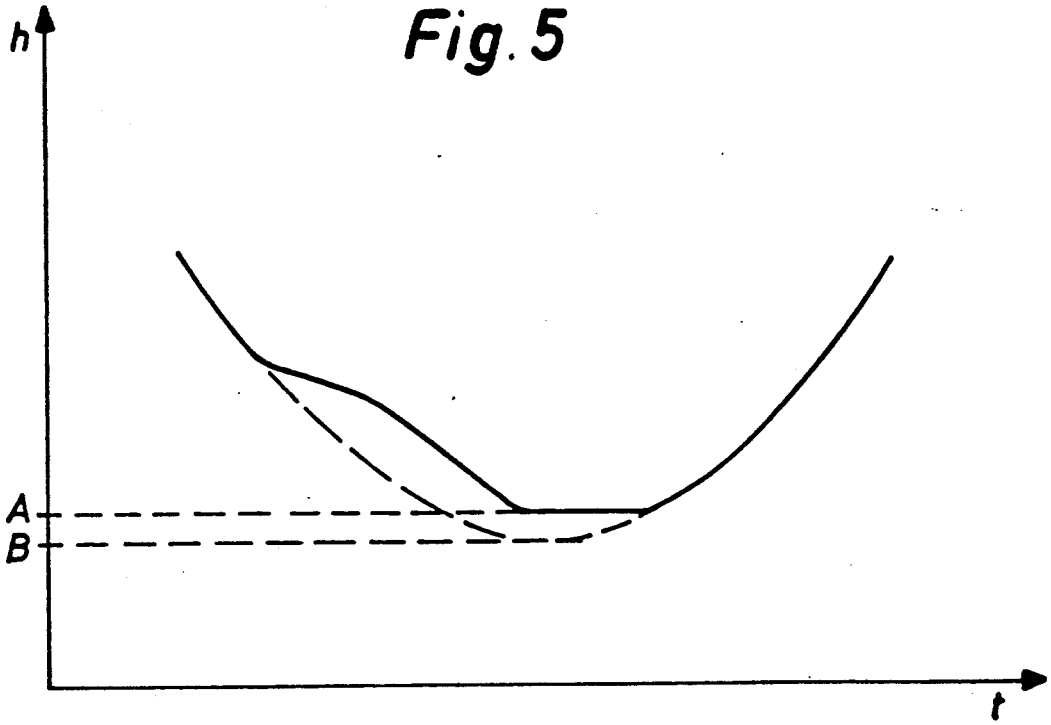
FIGS. 5 to 7 are diagrams, in which the cause of the movement of the ram in its lower dead point area is shown.
Figure 6:
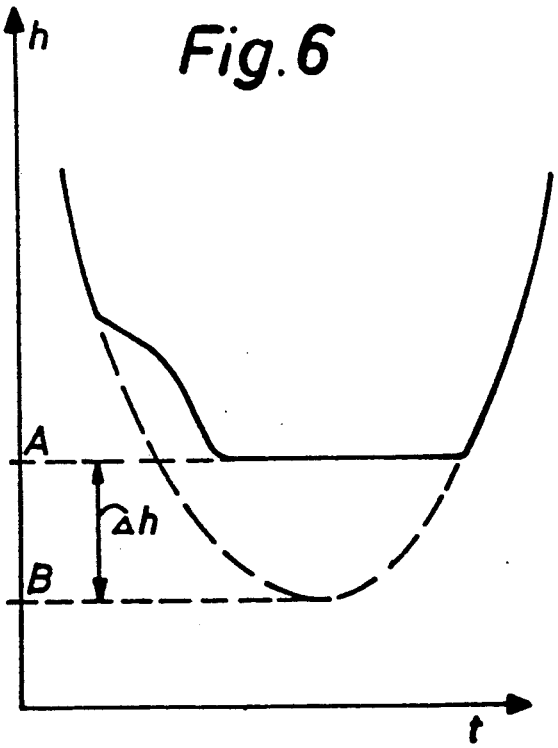
Figure 7:
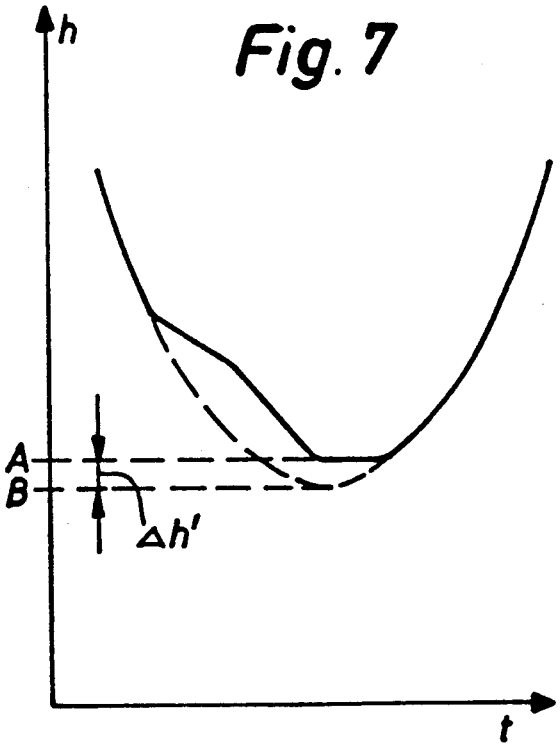

Attention is now drawn to FIGS. 5–7. These figures illustrate schematically the course of the ram in the lower dead point area. The letter t represents the time and the letter h the travel of the ram.

FIG. 5 illustrates the course of the travel of the ram in case of a low number of strokes, for instance, when setting up a punching machine. If no fixed abutments are present, the lowermost position of the ram corresponds to the position B and the specific course of the ram without a fixed abutment and without any cutting or embossing work is illustrated in a broken line as a section of the travel. If fixed abutments are present, the travel of the ram (including the cutting and embossing work) follows the continuously drawn curve, where now the lowermost position of the ram is at A. Specific attention is now drawn to the fact that the travel of the ram at its lowermost position is designed as a rectilinear line due to the fixed abutment. A further moving down of the ram does not occur. Accordingly, an exactly defined lowermost relative position of the punching tool lower part is designed by the fixed abutments.

In FIG. 6 the extent of the travel of the ram in the lower dead point area during the working operation is designed. Without fixed abutments, without a controlling of the height position of the ram or a correcting thereof, respectively, and without any cutting or embossing operation, the path of the ram extends in accordance with the curve illustrated with a broken line such to reach the lowermost position of the ram as illustrated by the letter B.

In case of fixed abutments and a cutting or embossing, respectively, operation the path of the ram extends along the line drawn in full, whereby the lowermost position of the ram A is indicated. Attention is now drawn to the relatively long horizontal line, i.e. accordingly relatively long time span, during which conclusively the striking force acts onto the fixed abutment. The large difference Δh from A to B is an indication of a high striking force onto the fixed abutments.

FIG. 7 illustrates the same operating condition of the punching press as is the basis of FIG. 6. The extent of the course of the ram in case of fixed abutments and a controlling of the height position of the ram, which latter is controlled in dependence on the striking force exerted onto the abutment, extends now along the fully drawn line of FIG. 7. The lowermost position of the ram is again identified by A. The time span, during which this lowermost position of the ram is present such as illustrated by the horizontally extending part of the line, is at A now considerably shorter in comparison with the course of the ram according to FIG. 6. The broken line, which again illustrates the lowermost position of the ram B, illustrates such without fixed abutments, but including an adjusting of the height of the ram.

The small difference Δh' between A and B proves the small striking force exerted onto the rigid abutments.

The feeler or feelers, respectively, can also take the form of a separate structural unit which is separated from the fixed abutment and mounted on the side or directly under the fixed abutment for directly measuring the striking force exerted by movement of the punching tool upper part with respect to the punching tool lower part during a punching operation. In addition, instead of the utilization of separate fixed abutments attached to the tool, the abutments can be formed as part of the punching tool upper part or punching tool lower part.

While there is shown and described the present preferred embodiment of the invention, it is to be distinctly understood that the invention is not limited thereto, but may be otherwise variously embodied and practiced within the scope of the following claims.

I claim:

1. A method of reducing the punching stress of a punching machine having a ram, a punching tool upper part and a punching tool lower part, in which a relative position of the punching tool upper part and the punching tool lower part is determined by at least one mechanical stop located substantially between said punching tool upper part and said punching tool lower part, said stop being provided for stopping a punching stroke and for directly measuring a striking force exerted on the stop, comprising the steps of:

directly measuring by means mounted on said stop a striking force exerted in said mechanical stop by movement of said punching tool upper part with respect to said punching tool lower part in a punching operation; and adjusting a height position of the ram in dependence of the measured striking force whereby said striking force remains within a predetermined range.

2. The method of claim 1, further comprising the step of measuring said striking force by sensing deformation of said mechanical stop due to said striking force.

3. The method of claim 2, wherein the sensed deformation is of an elastic nature and is transformed into an electric signal which is amplified and thereafter fed to a control unit operative to control a driving means for the adjusting of the height position of the ram.

4. The method of claim 1, wherein the measuring of the striking force and the adjusting of the height position of the ram are carried out during the working operation of the punching machine.

5. Apparatus for reducing the punching stress of a punching machine having a ram, a punching tool upper part and a punching tool lower part and at least one fixed stop operative to determine a relative position of the punching tool upper part and the punching tool lower part, said at least one fixed stop being mounted in at least one of the punching tool upper part and the punching tool lower part, and a control means having an adjusting motor operative to adjust a height position of the ram during the working operation of the machine, the apparatus comprising:

said fixed stop located substantially between said punching tool upper part and said punching tool lower part, said stop being provided for stopping a punching stroke and for directly measuring a striking force exerted on the stop;

sensing means for directly sensing a striking force exerted on the fixed stop by movement of said punching tool upper part with respect to said punching machine lower part in a punching operation, said sensing means being mounted on said stop;

adjusting means for adjusting the height position of the ram, said adjusting means being coupled to said sensing means, whereby an output signal of said sensing means is transmitted to said adjusting means.

6. The apparatus of claim 5, wherein said sensing means includes a structural member for measuring a deformation of the fixed stop and a transforming thereof into an electrical signal.

7. The apparatus of claim 6, wherein said structural member for measuring a deformation of the fixed stop senses an elastic deformation of the fixed stop in a direction of the stroke of the ram.

8. The apparatus of claim 7, wherein said structural member includes a wire strain gauge or a piezoelectric gauge mounted to the respective fixed stop.

9. The apparatus of claim 5, wherein said means for sensing the striking force exerted on the fixed stop includes an electronic circuit separated from the fixed stop.

10. A method a reducing the punching stress of a punching machine having a ram, a punching tool upper part, a workbench and a punching tool lower part, in which a relative position of the ram and the workbench is determined by at least one mechanical stop located substantially between said ram and said workbench, said stop being provided for stopping a punching stroke and for directly measuring a striking force exerted on the stop, comprising the steps of:

directly measuring by means mounted on said stop a striking force exerted on said mechanical stop by movement of said ram with respect to said workbench in a punching operation; and adjusting a height position of the ram in dependence of the measured striking force whereby said striking force remains within a predetermined range.

11. The method of claim 10, further comprising the step of measuring said striking force by sensing deformation of said mechanical stop due to said striking force.

12. The method of claim 11, wherein the sensed deformation is of an elastic nature and is transformed into an electric signal which is amplified and thereafter fed to a control unit operative to control a driving means for the adjusting of the height position of the ram.

13. The method of claim 10, wherein the measuring of the striking force and the adjusting of the height position of the ram are carried out during the working operation of the punching machine.

14. Apparatus for reducing the punching stress of a punching machine having a ram for supporting a punching tool upper part and a workbench for supporting a punching tool lower part and at least one fixed stop operative to determine a relative position of the ram and the workbench said at least one fixed stop being mounted in at least one of the ram and the workbench, and a control means having an adjusting motor operative to adjust a height position of the ram during the working operation of the machine, the apparatus comprising:

said fixed stop located substantially between said ram and said workbench, said stop being provided for stopping a punching stroke and for directly measuring a striking force exerted on the stop;

sensing means for directly sensing a striking force exerted on the fixed stop by movement of said ram with respect to said workbench in a punching operation, said sensing means being mounted on said stop;

adjusting means for adjusting the height position of the ram, said adjusting means being coupled to said sensing means, whereby an output signal of said sensing means is transmitted to said adjusting means.

15. The apparatus of claim 14, wherein said sensing means includes a structural member for measuring a deformation of the fixed stop and a transforming thereof into an electrical signal.

16. The apparatus of claim 15, wherein said structural member for measuring a deformation of the fixed stop senses an elastic deformation of the fixed stop in a direction of the stroke of the 17. The apparatus of claim 16, wherein said structural member includes a wire strain gauge or a piezoelectric gauge mounted to the respective fixed stop.

18. The apparatus of claim 14, wherein said means for sensing the striking force exerted on the fixed stop includes an electronic circuit separated from the fixed stop.

* * * * *